United States Patent [19]

Sargent et al.

[11] 4,305,164

[45] Dec. 15, 1981

[54] PORTABLE TOILET FACILITY

[75] Inventors: Frank T. Sargent; Charles L. Sargent, both of Ann Arbor; James T. Embach, Saline; John M. Antos, Ann Arbor, all of Mich.

[73] Assignee: Thetford Corporation, Ann Arbor, Mich.

[21] Appl. No.: 86,742

[22] Filed: Oct. 22, 1979

[51] Int. Cl.[3] ..... A47K 4/00; A47K 11/00; A47K 11/02

[52] U.S. Cl. ..... 4/462; 4/459; 4/460; 4/463; 52/173 R

[58] Field of Search ..... 4/459, 611, 300, 301, 4/460, 462, 463; 52/173

[56] References Cited

U.S. PATENT DOCUMENTS

| | | | |
|---|---|---|---|
| 3,407,549 | 10/1968 | Friedberg | 52/173 |
| 3,533,200 | 10/1970 | Zoebelein | 52/173 X |
| 3,800,335 | 4/1974 | Buonaura | 4/613 |
| 3,835,480 | 9/1974 | Harding | 4/459 |
| 4,152,789 | 5/1979 | Heath | 4/611 |
| 4,163,294 | 8/1979 | Patterson | 4/449 |

*Primary Examiner*—Henry K. Artis
*Attorney, Agent, or Firm*—Olsen and Stephenson

[57] ABSTRACT

A knock-down portable toilet facility that has components made of thermoplastic material and which can be shipped in a disassembled state, and which can be erected at a site of intended use by interconnecting the components.

7 Claims, 13 Drawing Figures

PORTABLE TOILET FACILITY

TECHNICAL FIELD

The present invention relates to portable toilet facilities, such as those that can be transported by trucks, or the like, to sites of intended use. The facilities can be serviced at the places of use to the extent necessary by removal of waste materials from the holding tanks, cleaning of the facilities, and the like. The facilities are particularly adapted for temporary use at new construction sites, fairs, recreational activities, and other locations or public gathering places where existing toilet facilities are inadequate.

BACKGROUND ART

It is conventional practice to provide a portable toilet facility including an enclosure having top, bottom and side walls, a door in one side wall, and a toilet with a holding tank in the enclosure. Facilities of this character are delivered in trucks as erected units. One known delivery truck has the capacity to carry twenty-two erected units. Servicing includes periodic evacuation of the holding tanks by tank trucks with hoses and pumping equipment.

DISCLOSURE OF THE INVENTION

The present invention is directed to improved portable toilet facilities which are constructed and arranged so that substantially greater numbers of units can be delivered per truck than was heretofore possible, thereby materially reducing delivery costs, and also so that existing units can be maintained in a better state of repair by permitting convenient replacement of any of the components of the units that may have become defective. Still further, the present invention is directed to a knock-down portable toilet facility that has prefabricated components that can be delivered in trucks and then easily and relatively quickly assembled at the sites of intended use. The prefabricated components can be delivered in the trucks in much greater density so that the aforesaid known delivery truck has the capacity to carry eighty unassembled units in place of the twenty-two erected units.

In its broadest aspects, a facility embodying the present invention is comprised of components that have interfitting joints allowing them to be dismantled and stacked to occupy a relatively small volume for transportation purposes and to be reassembled by fitting the components together again at a site of intended use of the facility.

Among the features of the present inventon are the improved construction and arrangement of the base member forming the bottom wall, the panels and edge members forming the side walls, the frame assembly and panels forming the top wall, the hinge assemblies for the door, and the embodiments of the toilets, urinals and associated holding tanks that are supported on the base member or on a suitable adaptor for accommodating special types of toilets that are to be supported on the base member. The various components that form the enclosure have joints that allow them to be assembled and disassembled conveniently and to be shipped as products that are substantially more dense than the erected portable toilet facilities found in the prior art. Further, the holding tanks are constructed and arranged in one form of the invention so that when it is desirable, the holding tanks that have been filled can be evacuated by a hose to a service tank or vehicle, and in another form of the invention, the holding tanks can be closed and replaced by empty holding tanks, and the filled holding tanks can be transported to discharge stations.

Other objects of this invention will appear in the following description and appended claims, reference being had to the accompanying drawings forming a part of this specification wherein like reference characters designate corresponding parts in the several views.

DESCRIPTION OF THE PREFERRED EMBODIMENT

Figure 1:
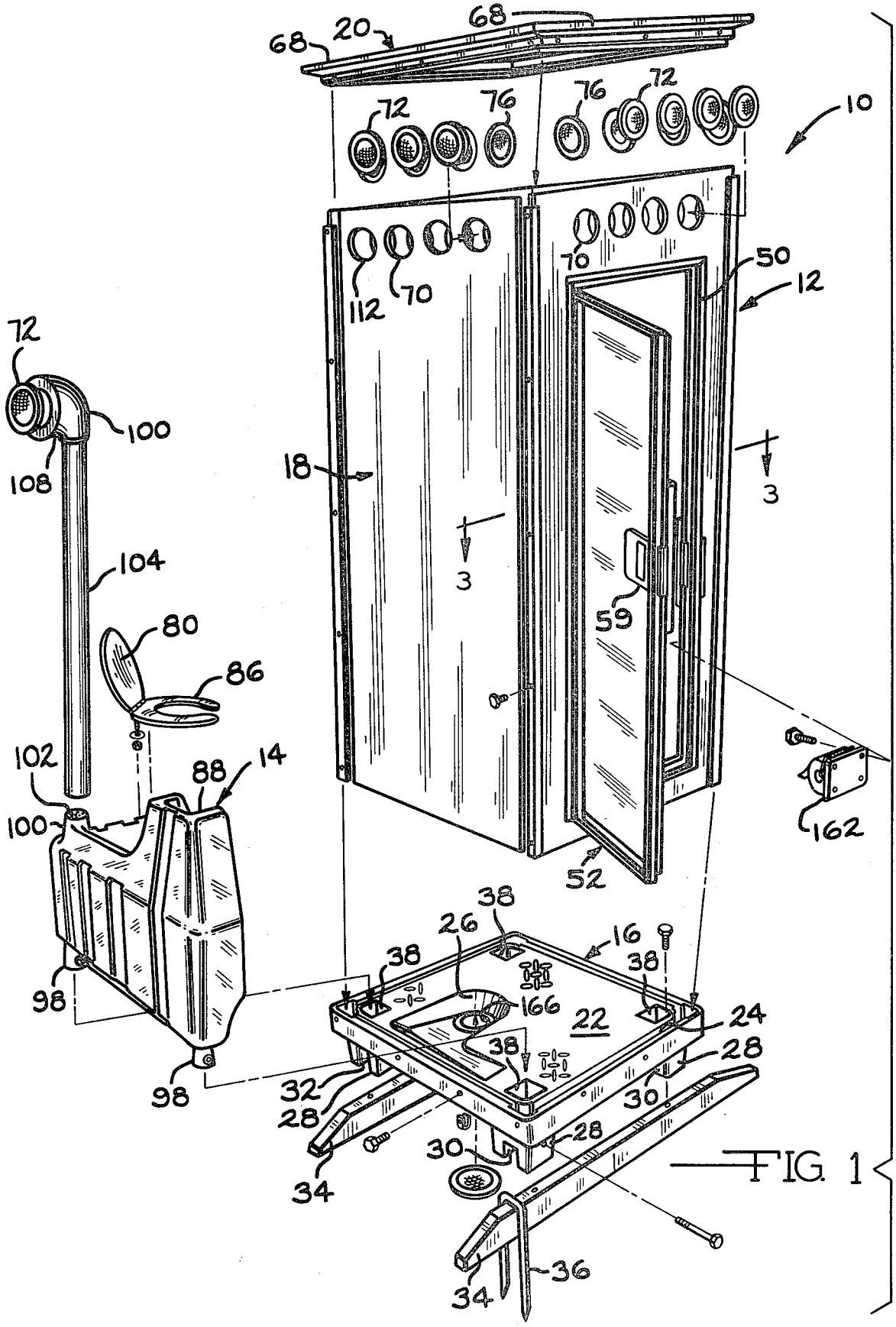
FIG. 1 is an exploded perspective view of a portable toilet facility embodying the present invention.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The portable toilet facility 10 includes the enclosure 12 and the toilet with the holding tank 14 that is located within the enclosure 12.

As will be understood, other forms of toilets, urinals, and holding tanks may be used in the enclosure 12.

The enclosure 12 includes the bottom wall 16, the side walls 18, and the top wall 20.

The bottom wall 16 comprises a base member 22 that has a channel 24 that opens upwardly around the periphery of base member 22. It also has a cavity 26 which can be any suitable shape to accommodate the bottom wall of one or more holding tanks to retain the latter in place within the enclosure 12. The base member 22 has legs 28 at each of its corners for supporting the remainder of the base member in spaced relation above a supporting surface. The pairs of legs 28 at the front side of the enclosure 12 have aligned slots 30 in the bottoms thereof, and in a similar manner, the legs 28 at the rear side of the enclosure 12 have aligned slots 32 in the bottoms thereof. The aligned slots of each pair of legs are adapted to receive skids 34 for increasing the stability of the portable facility 10. Hold-down stakes 36 may be utilized in conjunction with the skids 34, if further anchoring of these members is required. Also, additional cavities or sockets 38 may be located in the base member 22 for receiving support poles (not shown), if deemed necessary, or for receiving locating feet of the holding tanks, adapter platforms and the like, as will be described.

Figure 4:
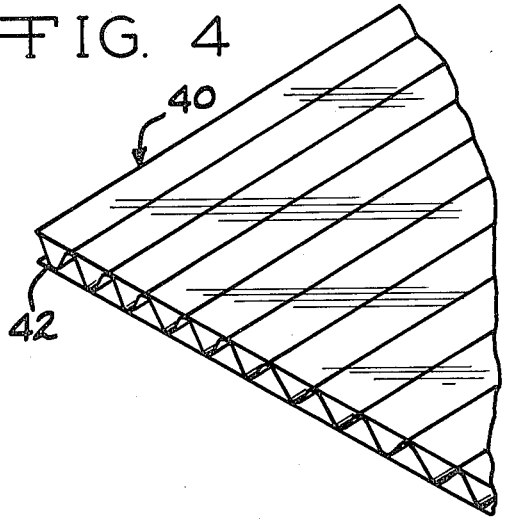
FIG. 4 is an enlarged perspective view of a fragment of the material that forms the panels in the walls of the embodiment of FIG. 1.

The side walls 18 includes panels 40, which preferably are formed of an extruded, double-walled, internally ribbed synthetic resin panel material, such as polyethylene, as is illustrated in FIG. 4. A suitable board or panel of this type is manufactured and sold by South Bay Growers, Inc., of South Bay, Fla. Due to this internally ribbed configuration, the panels may have very thin, lightweight plastic sections while retaining great stiffness and strength. The air channels 42 formed by the internal ribbing provide superior thermo-insulation characteristics for the material. Preferably, the panels are translucent to provide some degree of light while assuring privacy within the enclosure 12. Attractive color arrangements may be used, such as a dark blue outer skin and a light blue inner skin. If desired, the top wall panel, to be described, may be formed of a clear polyethylene panel or board.

The panels 40 have members 44 fixed to their vertical edges for connection with adjacent panels. The panels 40 have their ribs and air channels 42 extending in a horizontal direction.

In the illustrated embodiment, the front side wall has double panels 46 and the associated members 48 have double thickness grooves therein to receive the edges of the double panels 46. When double panels are used, the ribs of the one panel will be positioned parallel to the ribs of the other panel, thereby to enable identical panels to be fabricated.

The double panel 46 is utilized in the illustrated embodiment of the invention to provide maximum strength to the front side wall which has a door frame 50 therein, and in which is hingedly mounted the door 52.

The door 52 includes the double panel 54 which has its one vertical edge member hingedly connected to one vertical member of the door frame 50 as will be described, and it has at its other vertical edge a door jamb member 56 adapted to fit into the door jamb member 58 of the door frame 50. A suitable latch can be provided at 59. Again, it is preferred that the ribs in the two panels of the double panel 54 be arranged parallel to one another.

The top wall 20 comprises the frame assembly 60 which has a channel 62 that opens downwardly and in which the upper edges of the panels 40 are located. The frame assembly 60 also has grooves 64 around its inner periphery that open inwardly, and a double wall panel 66 closes the opening in the frame assembly 60 and has its inner edges in the grooves 64. Again, the double panel 66 has the ribs of one panel disposed parallel to the ribs of the other panel, but when the panels are aquare they can be arranged so that the ribs are perpendicularly disposed for the purposes of strength. The frame assembly 60 is formed from four frame edge members 68 that are an extruded synthetic resin material that has a continuous profile defining the channel 62 and the grooves 64.

As seen in FIG. 1, the side panels 40 have portholes adjacent to their upper ends, where they are located for ventilation purposes. Screens 72 are provided to be supported and retained in the portholes 70. For the purpose of securing the screens 72 in place, plastic pop-in fasteners 74 are provided, which can pass through the portholes 70 and be retained therein in a snap-fit relation. Preferably the screens 72 are injection molded of a suitable thermoplastic material and have associated therewith rings 76 for fitting on the inner sides of the walls 40 and over which the barbs 78 of the fasteners 74 snap-fit. As will be explained, one of the portholes 70 can be used in association with a vent pipe of the toilet, to be described.

Figure 2:
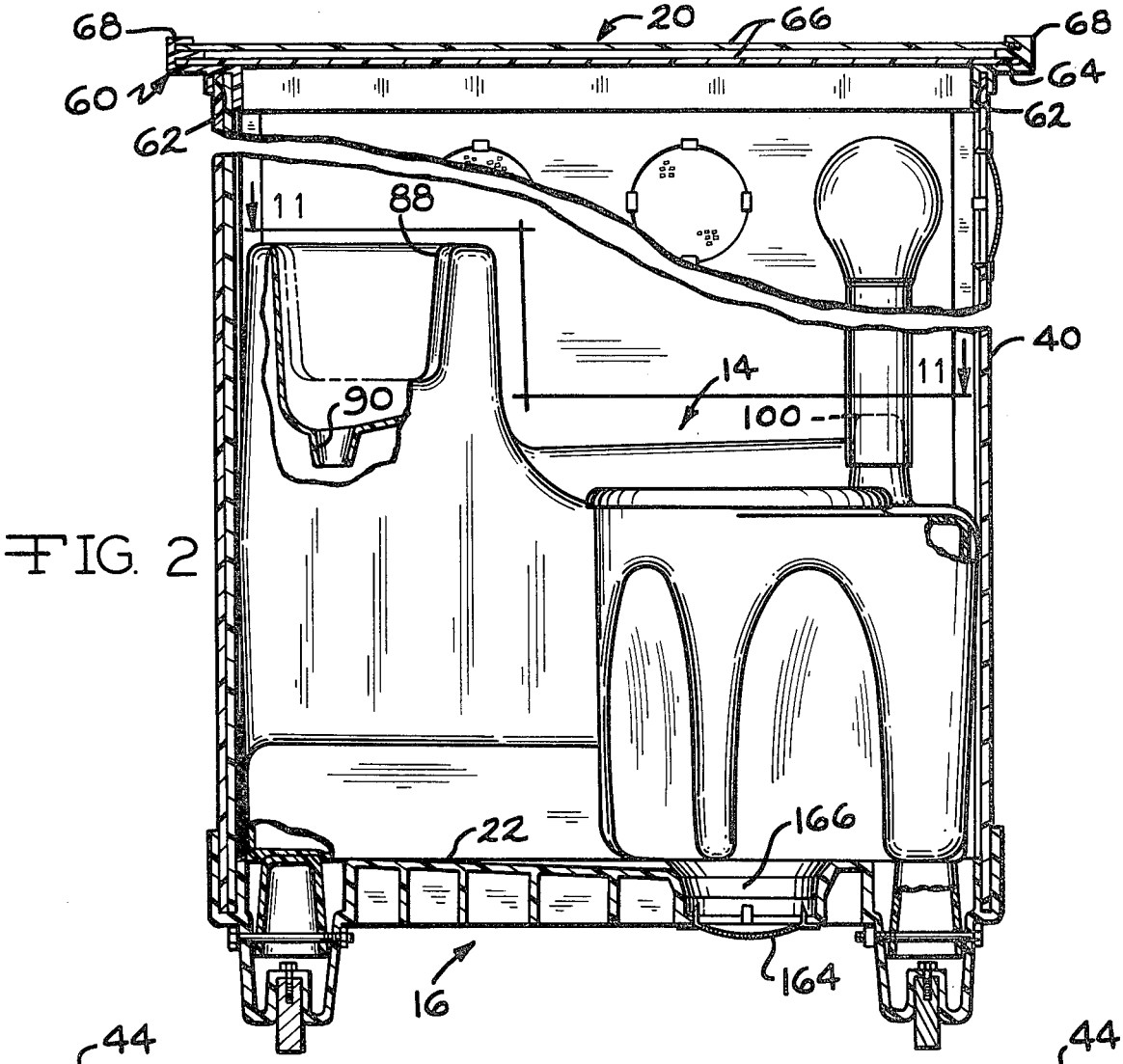
FIG. 2 is an enlarged fragmentary vertical section taken essentially through the midportion of the embodiment of FIG. 1.
Figure 3:
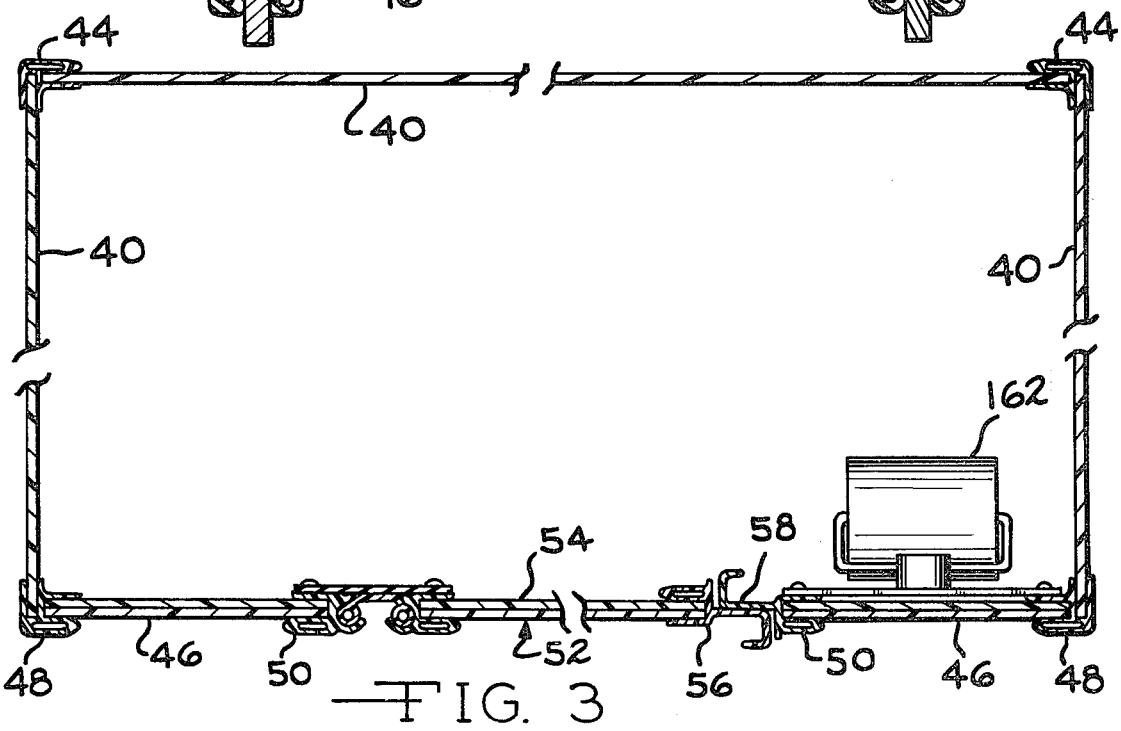
FIG. 3 is an enlarged fragmentary horizontal section taken on the lines 3—3 of FIG. 2.
Figure 11:
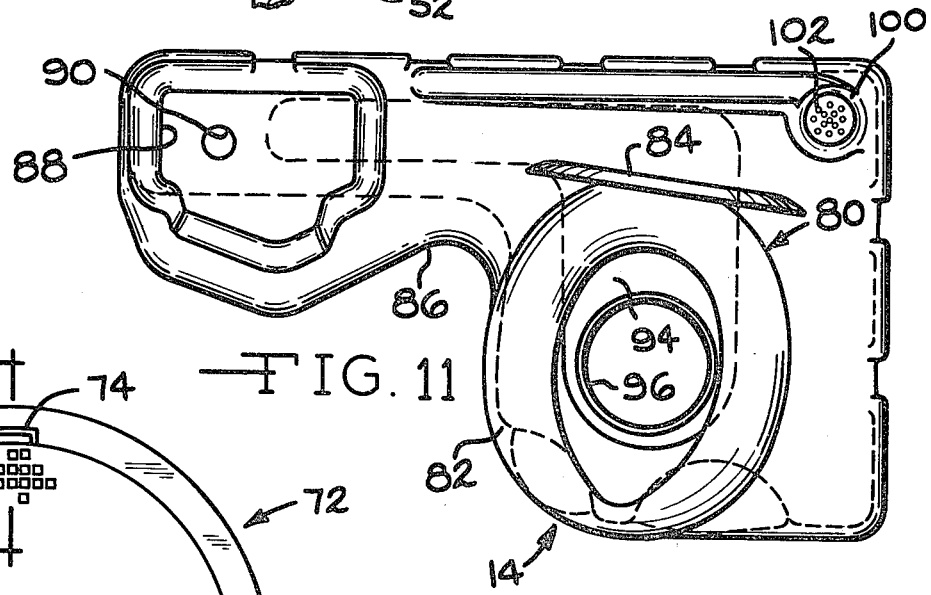
FIG. 11 is a top plan view of the toilet and urinal taken on the lines 11—11 of FIG. 2.
Figure 12:
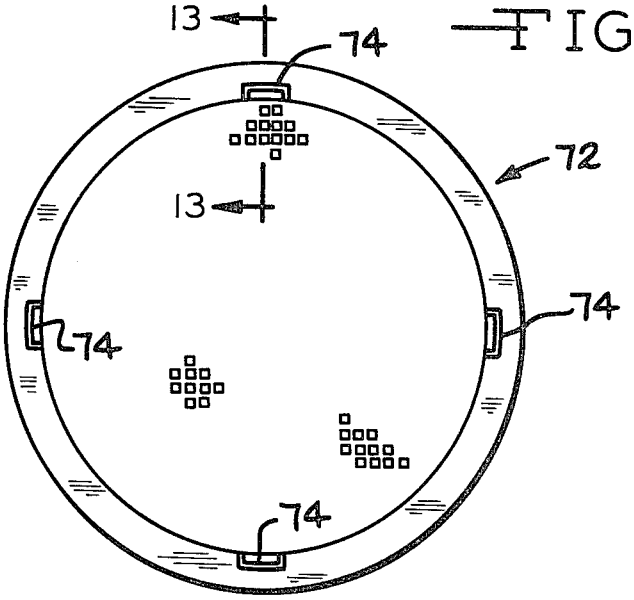
FIG. 12 is an enlarged elevational view of a screen of the type that is snap-fitted in the walls of the enclosure.
Figure 13:
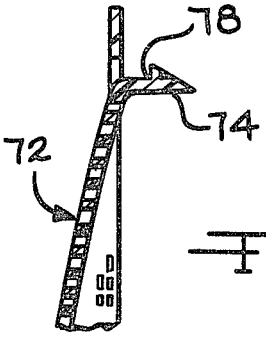
FIG. 13 is an enlarged fragmentary section taken on the lines 13—13 of FIG. 12, showing a retention element of the screen.

A preferred form of the toilet with an integral holding tank 14 is illustrated in FIGS. 1, 2, and 11, and as there shown, it includes a toilet 80 having a seat 82 and lid 84. The toilet is formed as an integral part of the holding tank 86. Integrally formed with the holding tank 86 is the urinal 88 that has a drainage port 90 for flow of liquid waste material to the interior of the holding tank 86. The waste material from the toilet 80 can be discharged from the toilet bowl 94 through the outlet 96 in the bottom thereof into the holding tank 86. The holding tank 86 has configurations in its bottom wall which correspond to the shape of the cavity 26 in the base member 22 so that the holding tank 86 can be positoned in the cavity 26 to be supported in a fixed position. In addition, locating feet 98 are provided for insertion into the sockets 38 of base member 22.

A holding tank vent fitting 100 is located in one corner of the holding tank and has apertures 102 therein for venting to the vent pipe 104 that is fitted onto vent fitting 100. The upper end of vent pipe 104 has an elbow 106 to which is connected the tube 108 on which is attached the screen 110. The latter is fastened at the port hole 112. For this purpose, the screen 110 can be the same as the other screens 72.

Figure 6:
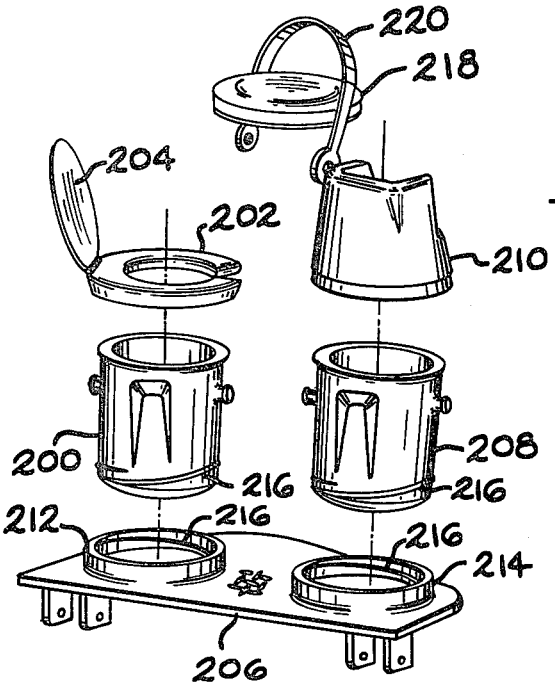
FIG. 6 is an exploded perspective view of a modified form of the toilet, urinal and holding tank apparatus that can be used in the enclosure of the embodiment of FIG. 1.

Attention is directed to FIG. 6 of the drawings wherein a modified form of the toilet and urinal apparatus is illustrated. As there shown, a holding tank 200 with a toilet seat 202 and lid 204 is provided which can be mounted on the adapter platform 206 over the cavity 26, and a second holding tank 208 is provided on which is removably located the urinal 210. The adapter platform 206 has feet 211 that are adapted to be located in the sockets 38 of the base member 22. The holding tanks 200 and 208 are adapted to be received in the receptacles 212 and 214 in which they can be threadedly connected by the threaded portions 216. The embodiment of the invention shown in FIG. 6 is particularly advantageous for use in situations where it is difficult to evacuate the holding tanks, and in these instances, the holding tanks 200 and 208 can be removed from the enclosure 12, caps 218 and handles 220 applied thereto, and they can then be transported to a place where the contents can be discharged. At the same time, empty holding tanks can be inserted in place thereof so that the portable toilet facility 12 can remain in use.

Figure 7:
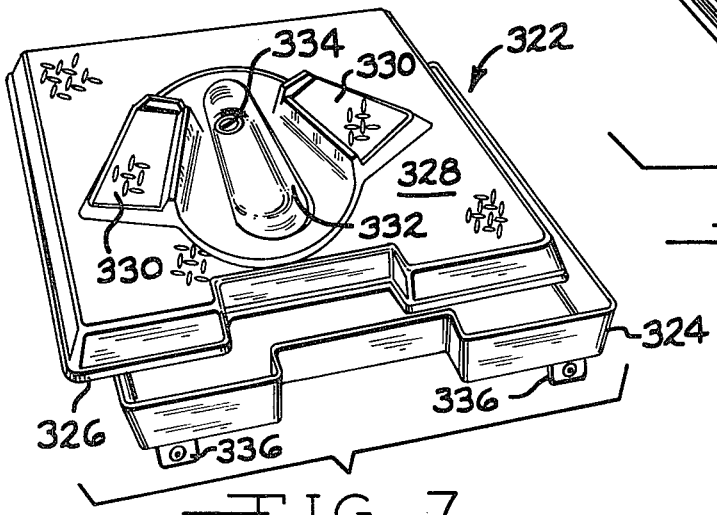
FIG. 7 is an exploded perspective view of still another modified form of the toilet urinal and holding tank apparatus that can be used in the enclosure of the embodiment of FIG. 1.

Attention is next directed to FIG. 7 of the drawings where another modified form of the toilet and urinal apparatus is illustrated. As there shown, a squat-type toilet such as is prevalent in the oriental and far eastern countries is provided. The toilet 322 includes a lower tray-like receptacle 324 which serves as a holding tank, and an upper removable cover member 326 that defines in its top wall 328 spaced foot rests 330 and a centrally located toilet bowl 332 having a discharge port 334 that opens to the receptacle 324. The receptacle 324 has feet 336 for insertion into the sockets 38 of the base member.

Figure 8:
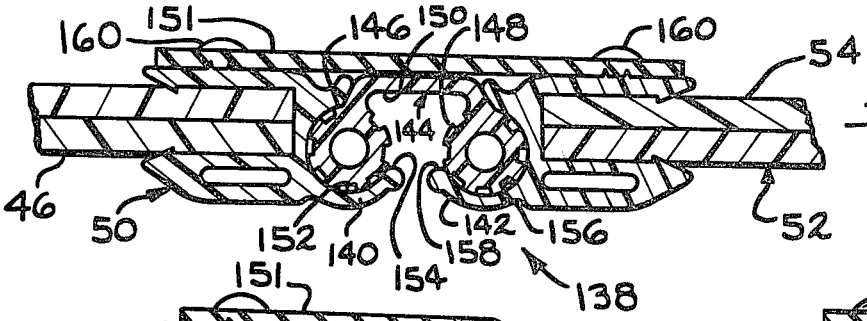
FIG. 8 is an enlarged fragmentary horizontal section through hinge apparatus for connecting the door to the door frame, showing the hinge apparatus in the closed position of the door.
Figure 9:
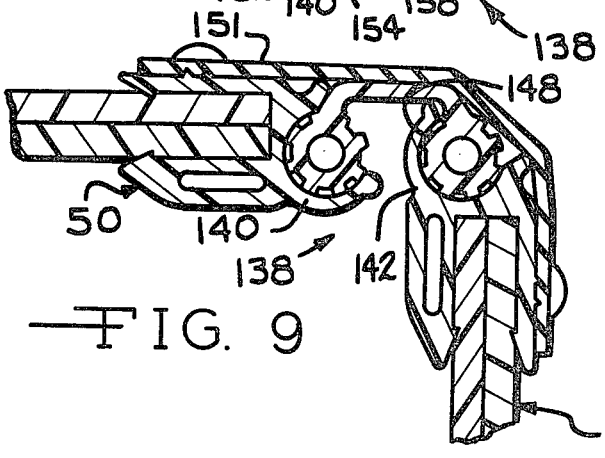
FIG. 9 is a section similar to that of FIG. 8, but showing the hinge apparatus in a partially open position of the door.
Figure 10:
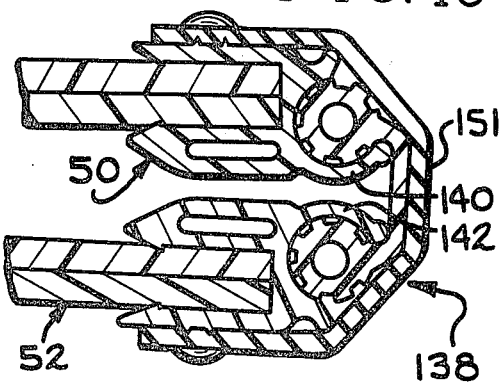
FIG. 10 is a section similar to that of FIG. 8, but showing the hinge apparatus in a fully open position of the door.

Attention is directed to FIGS. 8, 9, and 10 for a description of the hinge apparatus 138 which hingedly connects the door 52 in the door frame 50. The hinge apparatus includes a first hinge element 140 integrally formed in one vertical edge member of the door frame 50, a second hinge element 142 integrally formed in the vertical edge of the door 52 a dual hinge pin structure 144 having two parallel pins 146 and 148 jointed by an interconnecting web 150, and the spring member 151. The first hinge element 140 has a first vertical cylindrical-shaped socket 150 with a slot 154 through which the webbing 150 passes, and the second hinge element 142 has a similar second vertical cylindrical-shaped socket 156 with a slot 158 through which the webbing 150 also passes. The slots 154 and 158 are dimensioned and arranged so that the door 52 can initially be opened 90° to the position shown in FIG. 9 as a result of the relative turning of the door 52 and its hinge element 142 with respect to the pin 148, and thereafter, the door 52 can be opened 180° to the position shown in FIG. 10 as a result of the relative turning of the door 52 and dual hinge pin structure 144 in the hinge element 140 to the extent permitted by the slot 154. By virtue of this construction and arrangement, the door 52 can easily be opened to the position shown in FIG. 9 for ingress and egress by users of the toilet facility 10, and when servicing of the facility is to be performed, the door 52 can be opened further to the position shown in FIG. 10, and if desired, can be retained open in this position. The spring 151, which preferably is an elastomeric strip, can be attached to the hinge elements 140 and 142 by suitable attachment means, such as the screws 160.

Figure 5:
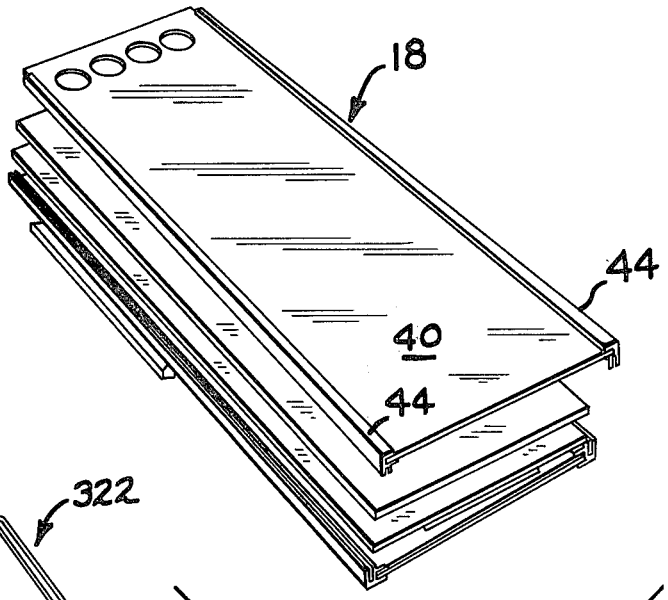
FIG. 5 is a perspective view of a stack of side walls for use in assembling a facility, such as the embodiment of FIG. 1.

In the normal use of the present invention, as many as eighty disassembled portable toilet facilities can be transported by a truck normally used for delivery purposes, and the disassembled components of the portable toilet facility can be unloaded at the sites for intended use of the facility. If desired, the side walls 18 can be transported in the arrangement shown in FIG. 5 where they are disconnected from one another. In the normal operation, the panels 40 will be attached to the edge members or extrusions 44 at the factory where the parts are originally fabricated. After the portable toilet facility 10 has been erected, it can be used and serviced to the extent necessary, after which the components can be disassembled for transportation to a new location. If any of the components are damaged, they can be replaced readily in the field by another similar component.

For manufacturing purposes, it is preferred that the panels be the extruded double-walled internally ribbed synthetic resin material described, the various edge members be extruded synthetic resin material with continuous profiles that define the grooves, channels and the like, and the base member be a molded unit made from a suitable synthetic resin material.

Conventional screws or other fasteners can be used for securing the various components together, and it is not deemed necessary to identify these fasteners by reference numbers. Likewise, a conventional toilet paper holder assembly 162 is mounted on the front wall of the enclosure 12. Also, a screen 164, of the same construction as the screens 72, is fitted to the drain port 166 in the cavity 26.

It is claimed:

1. A portable toilet facility including an enclosure having top, bottom and side walls, a door in one side wall, and a toilet with a holding tank in said enclosure, said facility being comprised of components that have interfitting joints allowing them to be dismantled and stacked to occupy a relatively small volume for transportation purposes and to be reassambled by fitting the components together again at a site of intended use of the facility, characterized in that said bottom wall is a base member having a channel that opens upwardly around the periphery of the base member, said base member having a cavity therein conforming to the shape of the bottom wall of the holding tank of said toilet, said holding tank being seated in said cavity, and said side walls are panels that have their lower edges in said channel and further characterized in that said toilet with a holding tank includes a toilet seat and lid, and a holding tank separable from the toilet seat and lid for removal of the holding tank from the enclosure, and in addition, a urinal with a holding tank is in said enclosure, the holding tank of the urinal being separable from the urinal for removal from the enclosure.

2. A portable toilet facility including an enclosure having top, bottom and side walls, a door in one side wall, and a toilet with a holding tank in said enclosure, said facility being comprised of components that have interfitting joints allowing them to be dismantled and stacked to occupy a relatively small volume for transportation purposes and to be reassembled by fitting the components together again at a site of intended use of the facility, characterized in that said toilet with a holding tank includes a toilet seat and lid, and a holding tank separable from the toilet seat and lid for removal of the holding tank from the enclosure, and in addtion, a urinal with a holding tank is in said enclosure, the holding tank of the urinal being separable from the urinal for removal from the enclosure, said holding tanks being buckets adapted to receive covers and handles for removal of the buckets from said enclosure, said bottom wall being a base member having cavities in its surface, and an adaptor platform is supported on said base member in mating relation with at least one cavity in said base member, said adapter platform having receptacles on its upper surface for receiving the bottoms of said buckets.

3. A portable toilet facility including an enclosure having top, bottom and side walls, a door in one side wall, and a toilet with a holding tank in said enclosure, said facility being comprised of components that have interfitting joints allowing them to be dismantled and stacked to occupy a relatively small volume for transportation purposes and to be reassembled by fitting the components together again at a site of intended use of the facility, characterized in that said toilet with a holding tank comprises a lower tray-like receptacle, and an upper removable cover member defining in its top wall spaced foot rests and centrally located therebetween a squat-type toilet bowl having a central discharge port opening to said tray-like receptacle.

4. A portable toilet facility comprising an enclosure having top, bottom and side walls, a door in one side wall, and a toilet with a holding tank in said enclosure, characterized in that said bottom wall includes a base member having a channel around its periphery that opens upwardly, said top wall includes a frame assembly with a channel that opens downwardly, and said side walls include panels that have their lower edges in the channel of said base member and their upper edges in the channel of said frame assembly, said holding tank is a pair of separate buckets, said base member has cavities in its surface, and an adaptor platform is supported on said base member in mating relation with at least one cavity in said base member, said adaptor platform having receptacles in its upper surface for receiving the bottoms of the buckets.

5. A portable toilet facility comprising an enclosure having top, bottom and side walls, a door in one side wall, and a toilet with a holding tank in said enclosure, characterized in that said bottom wall includes a base member having a channel around its periphery that opens upwardly, said top wall includes a frame assembly with a channel that opens downwardly, and said side walls include panels that have their lower edges in the channel of said base member and their upper edges in the channel of said frame assembly, said toilet with a holding tank comprises a lower tray-like receptacle supported on said base member, and an upper removable cover member defining in its top wall spaced foot rests and centrally located therebetween a toilet bowl having a discharge port therein opening to said tray-like receptacle.

6. A portable toilet facility including an enclosure having top, bottom and side walls, a door in one side wall, and a toilet with a holding tank in said enclosure, said facility being comprised of components that have interfitting joints allowing them to be dismantled and stacked to occupy a relatively small volume for transportation purposes and to be reassembled by fitting the components together again at a site of intended use of the facility, characterized in that said bottom wall is a base member having a channel that opens upwardly around the periphery of the base member, said base member having a cavity therein conforming to the shape of the bottom wall of the holding tank of said toilet, said holding tank being seated in said cavity, and said side walls are panels that have their lower edges in said channel, further characterized in that said top wall includes a frame assembly with a channel that opens downwardly and said panels have their upper edges in said channel of said frame assembly, and further characterized in that said side walls have a door frame therein for hingedly supporting said door, the hinge apparatus for hingedly connecting the door to the door frame comprising a first hinge element intergrally formed in one vertical edge of said door frame, said first hinge element having a vertical cylindrical-shaped socket for receiving a first hinge pin and providing a slot in the socket wall parallel to the axis of the socket, a second hinge element integrally formed in the vertical edge of the door adjacent to said one vertical edge of said door frame, said second hinge element having a second cylindrical-shaped socket for receivng a second hinge pin and providing a slot in the socket wall parallel to the axis of the socket, a dual hinge pin structure having two parallel pins interconnected by a web, said pins being located in the cylindrical sockets of said first and second hinge elements and the interconnecting web extending through said slots, said slots being located and having a width sufficient to allow the first hinge element to pivot approximately 90° from closed to an open position of said door and thereafter to allow the second hinge element to pivot about its axis an additional amount equal to approximately 90° to further open said door, and a spring member connected to said first and second hinge elements urging the second hinge element toward its closed position.

7. A portable toilet facility comprising an enclosure having top, bottom and side walls, a door in one said wall, and a toilet with a holding tank in said enclosure, characterized in that said panels are extruded double-walled internally ribbed structures and each side wall has at least one panel in which the ribs thereof extend horizontally, said one side wall has a door frame therein in which the outer edges have grooves, and the edges of said panel fit into said grooves, and a door is hingedly connected to said door frame, said door having edge members with grooves therein and a panel with its edges in the grooves of said door edge members, the hinge apparatus for hingedly connecting the door to the door frame comprising a first hinge element integrally formed in one vertical edge of said door frame, said first hinge element having a vertical cylindrical-shaped socket for receiving a first hinge pin and providing a slot in the socket wall parallel to the axis of the socket, a second hinge element integrally formed in the vertical edge of the door adjacent to said one vertical edge of said door frame, said second hinge element having a second cylindrical-shaped socket for receiving a second hinge pin and providing a slot in the socket wall parallel to the axis of the socket, a dual hinge pin structure having two parallel pins interconnected by a web, said pins being located in the cylindrical sockets of said first and second hinge elements and the interconnecting web extending through said slots, said slots being located and having a width sufficient to allow the first hinge element to pivot approximately 90° from closed to an open position of said door and thereafer to allow the second hinge element to pivot about its axis an additional amount equal to approximately 90° to further open said door, and a spring member connected to said first and second hinge elements urging the second hinge element toward its closed position.

* * * * *